United States Patent [19]

Florin et al.

[11] Patent Number: 4,646,640

[45] Date of Patent: Mar. 3, 1987

[54] PROCESS AND APPARATUS FOR CHRONOLOGICALLY STAGGERED INITIATION OF ELECTRONIC EXPLOSIVE DETONATING DEVICES

[75] Inventors: Johann Florin, Troisdorf; Friedrich Heinemeyer, Siegburg; Peter Röh, Troisdorf; Hansmartin Störrle, Norderstedt, all of Fed. Rep. of Germany

[73] Assignee: Dynamit Nobel Aktiengesellschaft, Troisdorf, Fed. Rep. of Germany

[21] Appl. No.: 685,115

[22] Filed: Dec. 21, 1984

[30] Foreign Application Priority Data

Dec. 22, 1983 [DE] Fed. Rep. of Germany ..... 3346343
Nov. 15, 1984 [DE] Fed. Rep. of Germany ..... 3441736

[51] Int. Cl.[4] ..... F42D 1/06; F42C 11/06

[52] U.S. Cl. ..... 102/217; 102/200; 102/215; 361/248

[58] Field of Search ..... 102/206, 215, 217, 218, 102/219, 220, 200; 361/251, 248

[56] References Cited

U.S. PATENT DOCUMENTS

| | | | |
|---|---|---|---|
| 3,560,863 | 2/1971 | Baumoel | 102/215 |
| 3,851,589 | 12/1974 | Meyer | 102/215 |
| 4,419,933 | 12/1983 | Kirby et al. | 102/206 |
| 4,445,435 | 5/1984 | Oswald | 102/215 |

FOREIGN PATENT DOCUMENTS

| | | | |
|---|---|---|---|
| 2945122 | 5/1980 | Fed. Rep. of Germany . | |
| 2093286 | 8/1982 | United Kingdom | 102/217 |

*Primary Examiner*—Charles T. Jordan
*Attorney, Agent, or Firm*—Antonelli, Terry & Wands

[57] ABSTRACT

For the chronologically staggered initiation of a plurality of electronic explosive delay detonators connected together with a blasting detonating machine, a signal current produced in each explosive detonator by signals sent by the blasting detonating machine, for example an impulse sequence, is integrated up in order to establish the delay time and, for carrying out of the delay, is integrated anew or integrated down to equality of the integrals or of the starting values. According to the invention, the integrating up begins in all explosive detonators simultaneously, with the end of the integrating up being controlled by signals from the blasting detonating machine. This end and accordingly the time period can be the same for all explosive charge detonators, while the two signal currents are possibly the same with the relative differences of the delay times being determined by the ratio of the signal currents which are different with setting and subsequent carrying out of the delay, or the end points of the integrations up or are different for each detonator. For increasing the safety, before the setting of the delay time, an impulse sequence with determined form is sent out from the blasting detonating machine and checked in each electronic explosive detonator so that the setting of false delay values by spurious signals is avoided. An energy storer in each explosive detonator is charged up only after successful checking of the impulse sequence at a value sufficient for initiation of the detonation.

30 Claims, 8 Drawing Figures

Figure 1:
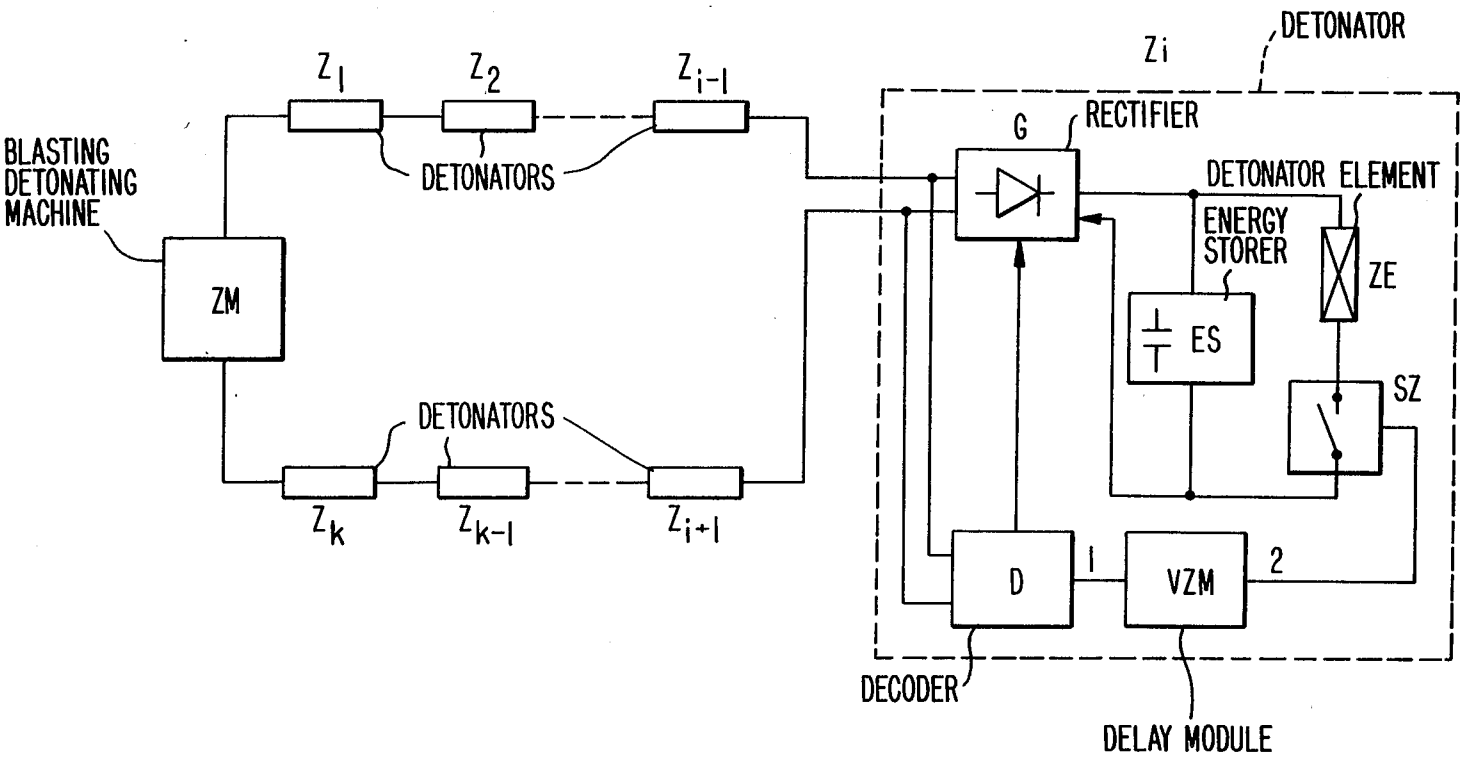

PROCESS AND APPARATUS FOR CHRONOLOGICALLY STAGGERED INITIATION OF ELECTRONIC EXPLOSIVE DETONATING DEVICES

The invention relates to a process and apparatus for the chronologically staggered initiation of electronic explosive detonating devices with their own delay times with respect to a command signal from a blasting detonating machine which is connected with the explosive detonators in a series and/or parallel circuit to at least one detonation circuit, in which in a charging phase determined by time signals from the blasting detonating machine, for the adjustment of the individual delay time in each of these detonators a first signal current from a source is supplied to an integrator and in a subsequent delay phase beginning simultaneously in all detonators with the command signal, a second signal current existing in predetermined dependence on the first signal current is supplied to the integrator sufficiently long until the integral of the first signal current stored in the integrator is reached or this is, decreased to zero, whereupon the detonation is initiated.

In a known procedure of this type (DE-A No. 29 45 122), a blasting detonating machine supplies to numerous connected explosive detonating devices an impulse sequence whose impulses are counted by a counter contained in each detonator. With a first numerical value from the counter specific to a detonator, the impulses from an impulse source contained in the detonator are supplied to an integrator constructed as a forward/return counter, which is charged thereby. The charging ends for each of the detonators when its first counter has reached a second numerical value. The first counter counts further after this and after achieving a third numerical value, which is the same for all detonators, the integrator is reversed so that the subsequent impulses from the impulse source are counted backwards and the contents of the integrator decrease. If the contents of the integrator have decreased to a predetermined value, which can be zero, the detonation is initiated. The individual delay periods of the individual detonators are preserved in the known system in such a way that the integration operation begins at different times, i.e. that the first numerical values of the first counter of the individual integrators are set differently. The charging phases of the integrators of all detonators differ accordingly in their starting times. The same delays, which occur with reference to the starting times of the charging phases result later also in the ending of the charging phase. During this, either that detonator whose integrator charging has begun last can detonate as the first because the integrator has only been charged up to a lower value or, if all integrators are charged to the same value, detonates as the last detonator to detonate is that whose charging has begun last. The known detonation system is expensive from the position of circuit technology because there are required in each detonator, in addition to the counter, these two comparators by which the first and second values of this counter are determined.

The invention is based on the object of providing a process of the known type in which the cost in the detonators from the point of view of circuit technology is reduced.

The solution of this object consists according to the invention in that the supply of the first signal currents to the integrators of all detonators begins simultaneously and, for each detonator, the individual delay time is determined only by the end of the supply of the first signal current in accordance with the time signals and by the ratio of the two signal currents to one another.

With the process according to the invention, the integrators are started together as a group at the detonators connected to the blasting detonating machine when the time signals started together occur so that no individual adjustments in the detonators are required in relation to the beginning of the charging phase. The end of the charging phase can be established specifically for the detonators, although there also exists the possibility of equalizing the length of the charging phase for all detonators. In each case, the cost of the necessary comparators in the circuit of the detonators is reduced. The reduction in the circuit cost in the detonators is important because the detonation switch is only used once and is destroyed on detonation of the pyrotechnic charge. The detonation switch should therefore be constructed as simply and inexpensively as possible.

On use of the process according to the invention, there can be produced in the electronic explosive delay detonators, after their insertion in the shot holes and wiring up with each other, a voltage as a result, in particular, of electromagnetic fields, at the inputs of some individual explosive detonators which the electronic elements already put into operation and produce undefined situations therein so that the subsequent adjustment of the individual delay time does not take place correctly. Furthermore, it is also possible that, on setting of the individual delay time by superposed spurious signals, false situations occur. In order therefore to achieve an increased safety in the setting of the individual delay times by the signal of the blasting detonating machine according to the invention, it is appropriate that, according to one embodiment of the invention, before the time signal from the blasting detonating machine, a first predetermined number of released impulses is transmitted in a first time sequence and during its length one of the signal currents is integrated and then a second predetermined number of starting impulses different from the first number is transmitted in a time sequence decreasing from the first time sequence although possessing the same length and during this period this signal current is likewise integrated, and that then the detonation is only initiated if the decrease in the integral formed during the first time period by the integral formed during the second time period lies below a predetermined limit after the receipt of a predetermined total number of impulses. In this way it is secured that the setting of the individual delay times and also the initiation of the explosive delay detonators only then takes place when the signals produced by the blasting detonating machine are processed in trouble free manner by the explosive delay detonating devices. The expenditure in the individual electronic explosive delay detonators increases somewhat in this way, although this is more than compensated by the additionally obtained safety in operation.

It is convenient that the first time sequence is a predetermined first constant frequency and the second time sequence a predetermined second constant frequency. In this way, the impulses may be easily controlled in both time intervals.

In order to prevent an explosive detonating device which has not correctly processed the release impulses and subsequent starting impulses, from not being adjusted and accordingly then also not released, it is appropriate that the sequence of the first and second time sequences is repeated at least once and the release of the starting impulse only then takes place when at the end of at least the second time sequence the decrease of both sequences lies below the predetermined value and that, with a greater decrease, the integrals are set back to an initial value. In this way, it is achieved that at least after the first sequence of the first and second time sequences following one another, defined settings are present in the explosive delay detonators and the next sequence of impulses is processed without trouble.

With the use of the previously set-out embodiments of the process according to the invention for increasing of the safety, it is necessary to distinguish in explosive delay detonators between the release and starting impulses as well as the subsequent signal for adjusting of the individual delay time. In order to carry this out easily, a further embodiment of the invention is characterised in that the sequence one after the other of the first and second time sequences is repeated at least once and the release of the starting impulse only then takes place if at the end of at least a second time sequence the reduction of the two integrals lies below the predetermined limit, and that with a greater decrease the integrals are reset to a starting value.

With the initially indicated known process, the explosive delay detonators possess an energy store to which energy is supplied from outside and which energises the elements of the electronic delay detonators and supplies the energy to the detonators of the detonator element. In order to prevent an explosive delay detonator being initiated uncontrollably with strong spurious signals, it is appropriate that the value of the integral achieved at the end of the charging phase or at the end of each first time sequence is set to the opposite value and afterwards is integrated in the same direction as previously. In this way, a sufficient energy supply to the detonation element is only then possible if the explosive delay detonator has processed the sequence of release impulses and starting impulses correctly. The reproduction of such a sequence by spurious signals is however practically excluded.

The invention relates further to an electronic explosive delay detonator for connection to at least one blasting detonating machine supplying at least one time signal, with a signal source which supplies, in a charging phase determined by the time signal, a first signal current for charging of an integrator, and with a control arrangement, which, after elapse of the charging phase, enters a delay phase in which the signal source supplies a second signal current for discharging or for renewed charging of the integrator, with a detonation signal being produced if the contents of the integrator decrease to a predetermined value or, with renewed charging of the integrator, the stored integration value of the charging phase is reached.

With such an explosive detonating device, it is provided according to the invention that the signal source is reversible so that it produces the two signal currents with different values.

The values of the two signal currents stand in a fixed ratio to one another which is specific to the detonator. In this way, the ratio of the length of the charging phase and delay phase for each individual detonator can be made different, with the charging phases for all detonators being equally long. There also exists the possibility of making the delay phase, as a matter, of choice greater or smaller than the charging phase.

Preferably, the signal source contains an impulse generator to which a frequency submultiplier is connected and the first signal current flows through the frequency submultiplier, while a second signal current flows directly from the impulse generator to the integrator formed as a counter. The signal source here needs only to contain a single impulse generator so that it is ensured that the impulses in the charging phase have the same frequency as in the delay phase. In the charging phase, a frequency submultiplication by the frequency submultiplier takes place. The impulse frequencies in the two phases do not need to be in a whole number ratio to one another; the frequency submultiplier moreover can also be so constructed that it makes possible a non whole number ratio (e.g. 3:8). This is possible with known PLL switches (Phase Locked Loop).

With another embodiment of the invention, the signal source contains two constant current sources with different current values and the integrator contains a charging condensor. With this, the charging and discharging of the integrator takes place by an analogous switching technique with the one constant current source being able to form one source and the other constant current source being able to form a sink for the integrated current.

Another variant of the electronic explosive delay detonator of the known type is characterised in that the control arrangement of every detonator introduces the first signal current at the first impulse of the time signal supplied as an impulse sequence and maintains it up to an m-th impulse specific to the detonator and begins the second signal current at the n-th impulse of the time signal, with $m \leqq n$. With this variant, the control apparatus can contain a counter which counts to the value (modulo-n-counter). It can be established by a comparator when the numerical value m is achieved. In this case, only a single comparator is required in addition to the counter. Instead of a counter, a slide register can also be used through which the first impulse of the time signal passes and which is timed by the impulses of the time signal. Such a slide register has n steps and an output at the n-th step and the m-th step.

In order to increase the safety on charging and possibly discharging of the integrator and on production of the detonation signal, it is appropriate that with the electronic explosive detonation device according to the invention in which the control arrangement contains a counter, there is provided a storage element, and that a predetermined counting setting of the counter corresponding to the sum of the counts of the impulses in a first and a second time sequence following thereon transmitted by the detonating machine switches over the first storage element when an integral formed during the first time sequence in the integrator decreases from an integral formed during the second time sequence by less than a predetermined value, and that the storage element only allows the initiation of detonation in the switched over setting. In this way it is first checked whether the explosive delay detonator receives the signals supplied by the detonating machine in order and can process them before the production of an detonation signal is allowed. It is appropriate for the storage element to bar the charging and possibly discharging of the integrator for the production of the detonation signal, before the switching over. In order to increase the safety further, a control switch can be provided which compares the value of the integral with predetermined limiting values.

For a further increase in the safety with electronic explosive delay detonators, in which an energy storer supplied from externally is provided for the operation of the electronic elements and of the detonation element, it is appropriate that only the switched over storage element allows the charging of the energy storer to a value sufficient for the detonation of the detonation element. In this way, a premature initiation of detonation by spurious signals is practically excluded.

In the following, the invention is explained further with reference to the constructional examples of the drawings.

Figure 2:
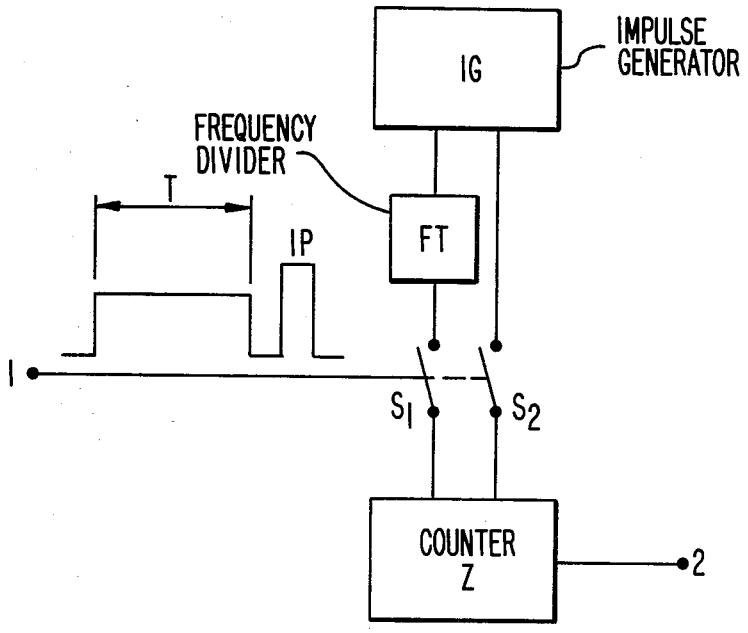
Figure 3:
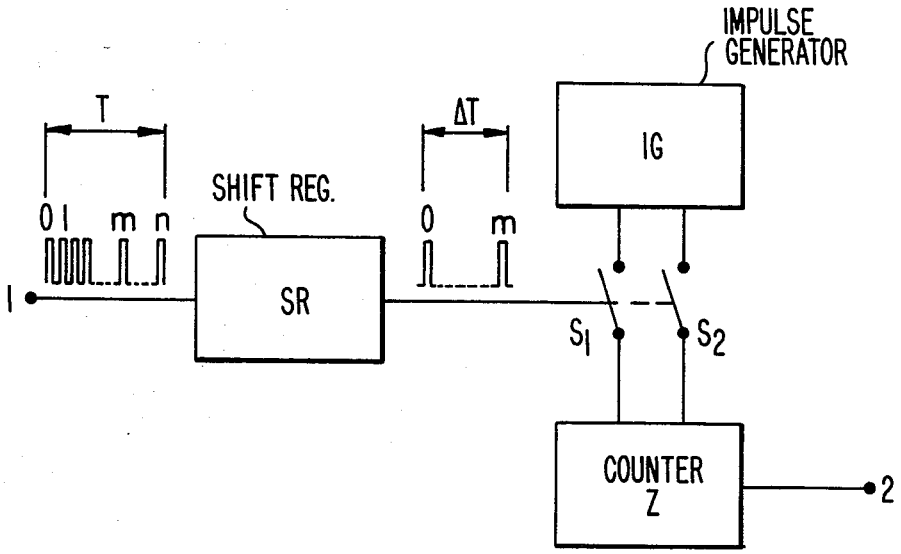
Figure 5:
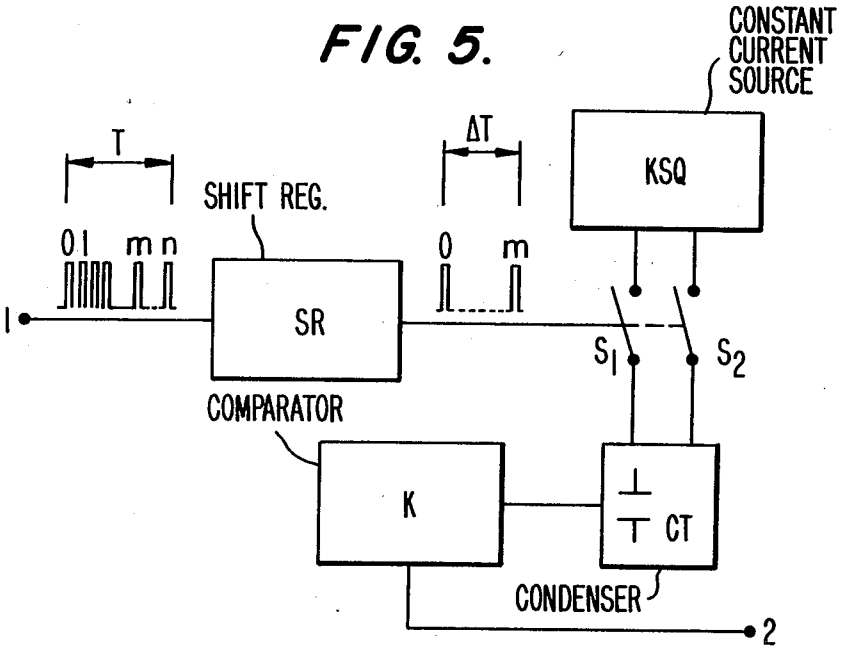
Figure 6:
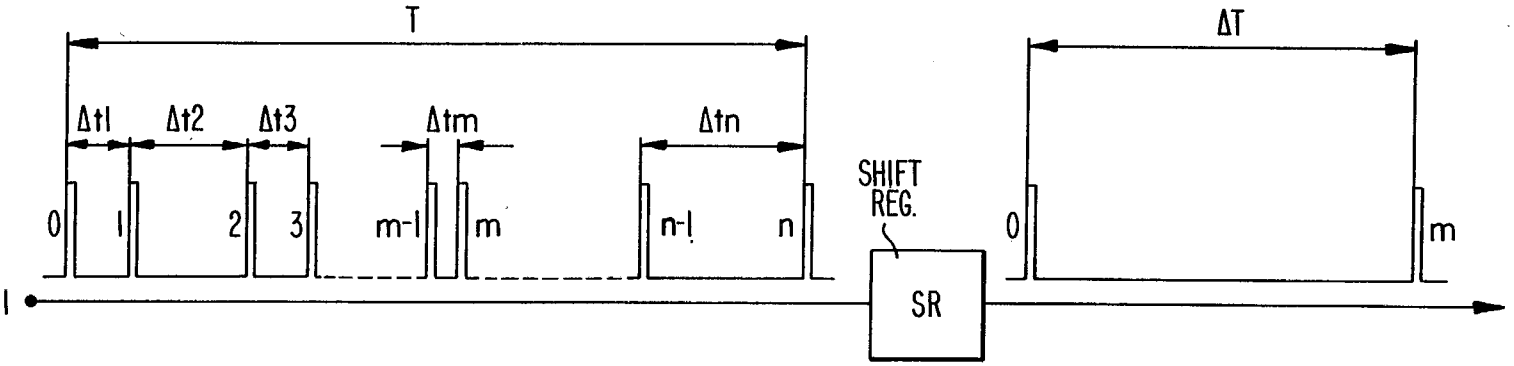
Figure 7:
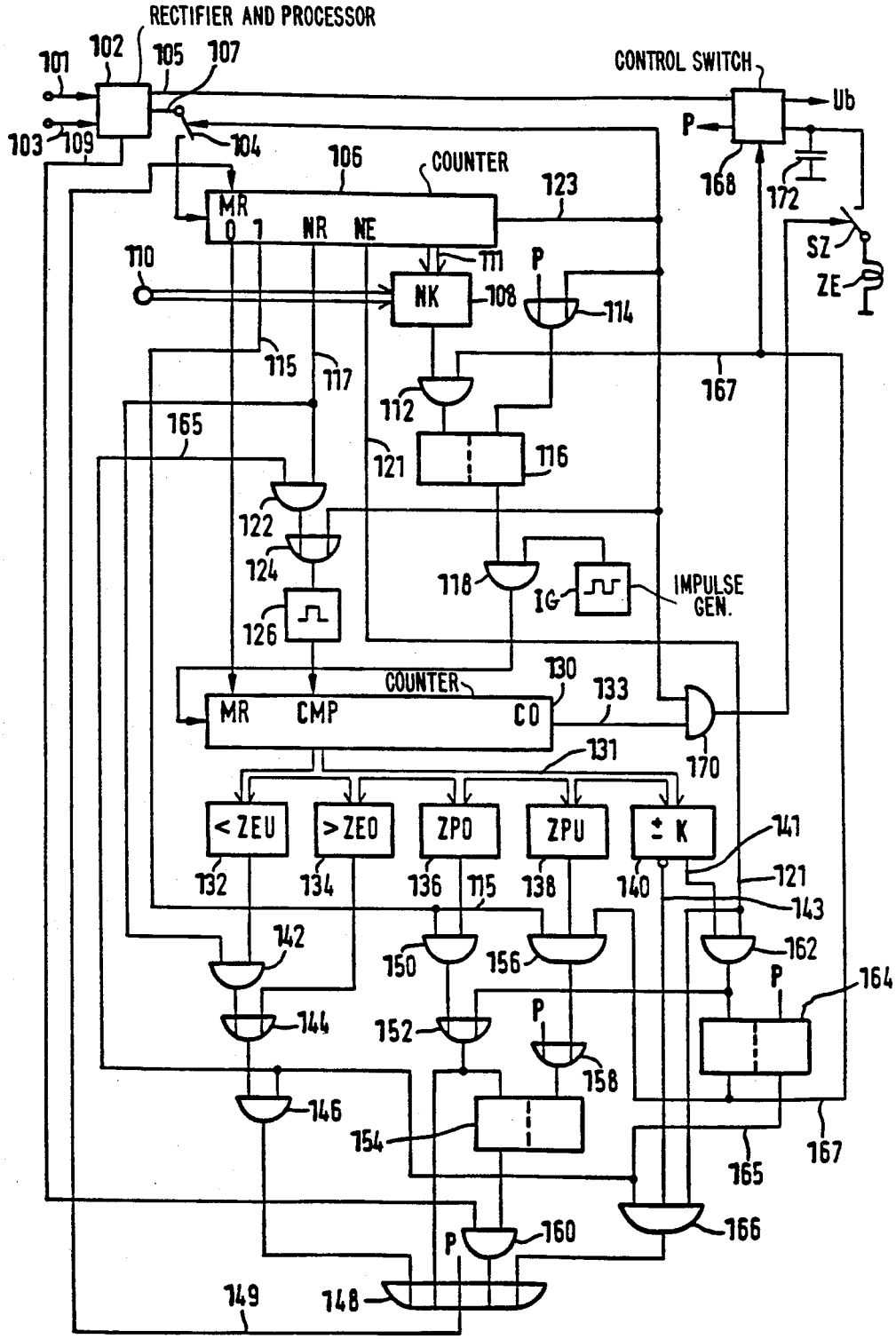
Figure 8:
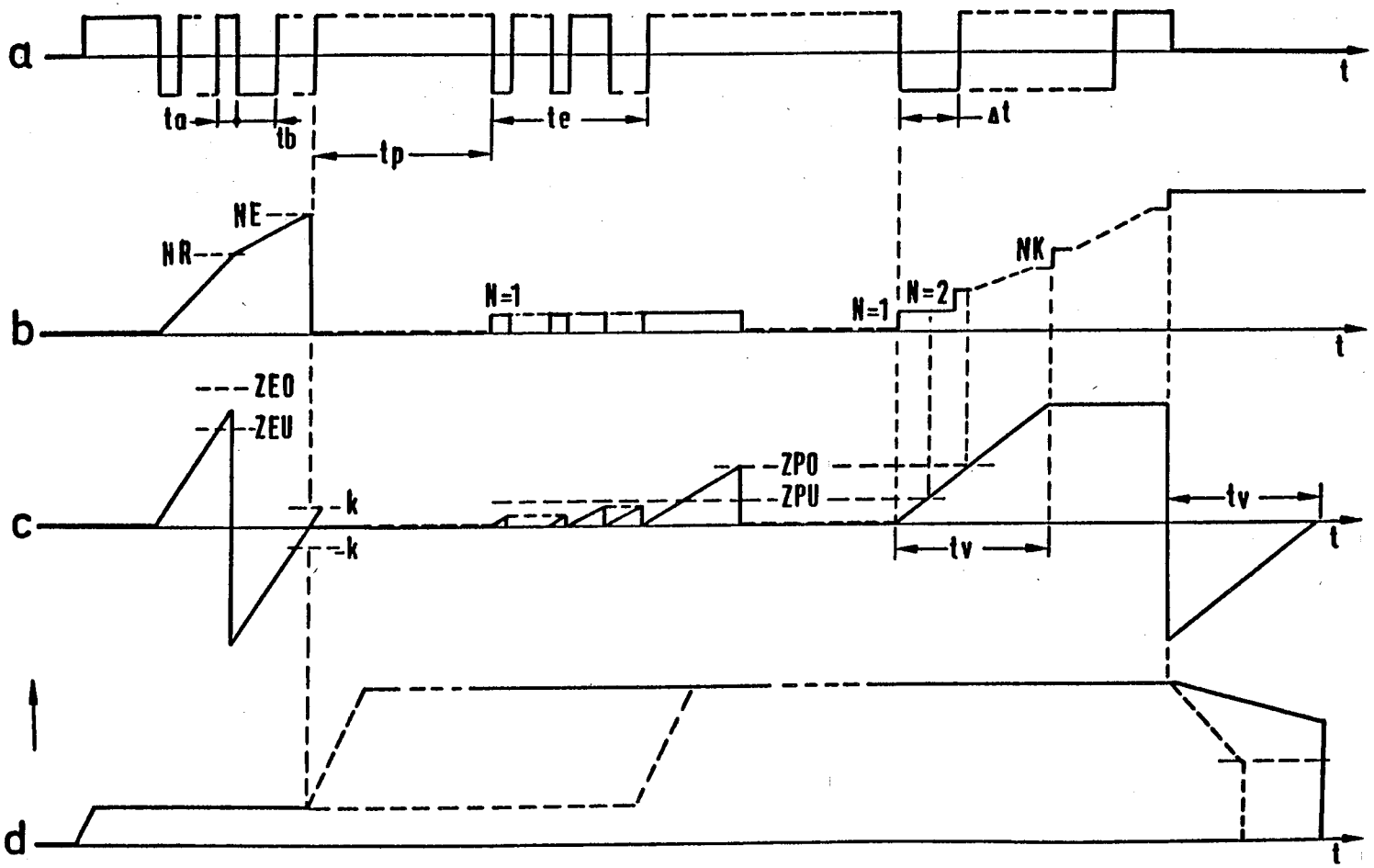

There is shown:

FIG. 1 a circuit with particular representation of a single detonator i,

FIGS. 2 to 5 different variants for the time delay module of the detonator i, FIG. 6 a variant to FIG. 3 or FIG. 5, FIG. 7 a circuit arrangement in which the setting of the delay time and the release is only carried out after a checking phase and FIG. 8 time diagrams for explaining the function of the switch according to FIG. 7.

According to FIG. 1 there are arranged a detonator $Z_1$ to $Z_k$ of a series k and the blasting detonating machine $Z_m$ belonging thereto. The blasting detonating machine has the object of supplying the detonators with energy and to supply signals to these which determine the time T and commence the detonation at the correct point in time.

The part of the block circuit diagram boxed in with a broken line shows a possible internal construction of the electronic part of the detonator $Z_i$. For the energy supply, for input of the delay interval length $\Delta T$ and for commencing of the initiation of all detonators $Z_k$, the detonating machine $Z_m$ supplies differently coded currents which are decoded in the decoder D. The coding can take place by frequency, amplitude and/or pulse code modulation.

On correct recognition of the code, the following result takes place: the energy storer ES constructed as a condenser is charged at the rectifier G and supplies the operating voltage for the total electronic part and the energy for detonation of the electric detonator element ZE . For simplification of the illustrated representation, the electronic components of the energy store ES are therefore not shown for the overall electronic part. The delay time $\Delta T$ of the individual detonator is realised in the delay time module VZM whose input 1 is connected to the decoder D and whose output 2 is connected to the electronic detonation switch SZ, e.g. a thyristor. This takes place preferably digitally by the comparison of the internal numerical setting, but optionally by analogue, e.g. by the comparison of charging voltages of condensers. After elapse of the time $\Delta T$, the switch SZ is closed, whereupon the energy storer ES is discharged through the detonation element ZE and this is detonated.

In FIG. 2 there is shown on its own a delay time module VZM of digital type. In the programming phase, a signal is supplied through input 1 during time period T. At the beginning of this, the switch $S_1$ is closed, whereupon impulses from the impulse generator IG through the frequency submultiplier or divider FT and the switch $S_1$ are counted in the counter Z. The frequency submultiplier works so that on an input of n impulses, only m impulses leave the submultiplier. In this way the ratio of m to n is inputted permanently into the frequency submultiplier of the respective detonator. Moreover, during the closure time T of the switch $S_1$ there are obtained in the counter Z the quantity $m/n.\ f_i.\ T$ impulses, with $f_i$ being the frequency of the impulse generator IG of the i-th detonator.

After elapse of the time period T, the switch $S_1$ is opened and the switch $S_2$ is closed simultaneously or even later, by means of a corresponding signal, for example of a separate impulse IP, which reproduces the detonation signal. Thereupon the impulses from the impulse generator IG are counted in the counter Z in such manner that its count input is counted backwards. If the counter Z has moreover again reached its starting setting, a corresponding signal is given through the output 2—as described in FIG. 1—to the detonation switch SZ.

Instead of this, it could also be provided for the impulses in a second counter with like initial setting to be counted with, if this has reached the same end setting as the first counter, a corresponding signal being again given through the output 2 to the detonation switch SZ.

In a numerical example for this, it may assumed that the switch $S_1$ is closed for the period $T=3$ s. At a frequency $f_i$ of the impulse generator IG of 5000 Hz, 15,000 impulses occur in the 3 s at the frequency submultiplier FT. With a frequency submultiplication with for example $n=64$ and $m=24$, 5625 impulses occur in the counter Z. After closing of the switch $S_2$, the detonation element ZE is then released corresponding to the ratio of 5625 to 5000 after 1.125 s, since then there is achieved in the counter Z the same counter setting as in the step previous, namely 5625 incoming impulses.

Should the impulse generator have a frequency $f_i=6000$ Hz, 6750 impulses would occur in the counter Z in $T=3$ s with the same submultiplication ratio of 24 to 64 of the frequency submultiplier FT, and, on closing the switch $S_2$, then the detonation element ZE would be detonated after 1.125 s, likewise corresponding to the ratio of 6750 to 6000.

This procedure guarantees in advantageous manner that the delay interval length $\Delta t$ must no longer be fixedly inputted into the detonator, that is it is no longer detonator specific but can be varied previously by the blasting detonating machine according to the time T. Furthermore with the digital switching technique it is guaranteed that the delay time is independent of the frequency of the impulse generator and accordingly of the tolerances of the electronic components and the surrounding influences. The preciseness of the delay time $\Delta T$ is therefore determined exclusively by the short term stability of the impulse generator IG which is responsible for the requirements occurring in practice, without further computation. On account of the digital method, the frequency submultiplier FT is also independent of the tolerances of its structural elements.

Since in all detonators of a detonation circuit, the switches $S_1$ are closed for the same length of time for the time period T, all detonators of the same time step m have the same delay time. The time step m is provided by the fixedly programmed ratio m/n in the frequency submultiplier. The delay time interval $\Delta t$ freely programmable by the blasting detonating machine is, for all detonators equally long, independently of time steps.

In the delay time module shown in FIG. 3, which is likewise explained in digital switching technique terms, impulses with the frequency $f_{ZM}$ are supplied from the blasting machine ZM to the shift register SR through the input 1 in the programming phase. The first impulse closes a switch $S_1$ and the m-th impulse with the number of impulses m being specific to the detonator—or optionally even one impulse corresponding to a whole numerical plurality of m—opens the switch $S_1$ again. For the closure time $\Delta T$, which is equal to the delay time of an detonator with the time stage m, $\Delta T = 1/f_{zm}$ consequently holds valid. The closure time and accordingly also the delay time is consequently capable of being set by the frequency selectable with the blasting detonating machine ZM.

During the closure time of the switch $S_1$, a number of impulses, $\Delta T \cdot f_1 = N_1$, with the frequency $f_i$ of the internal impulse generator IG are counted in the counter Z.

A further impulse of the blasting detonating machine ZM, which again represents the actual detonation impulse, closes the switch $S_2$, in the release phase after a predetermined time $t \geqq T = 1 \cdot n$ simultaneously with all detonators of a detonation circuit so that the counter contents $N_i$ of the counter Z are counted back to zero with the rate frequency $f_i$ or a second counter is likewise fully counted to $N_i$. On achieving the counter content zero or $N_i$, the detonation signal is supplied through the output 2 of the counter Z.

Figure 4:
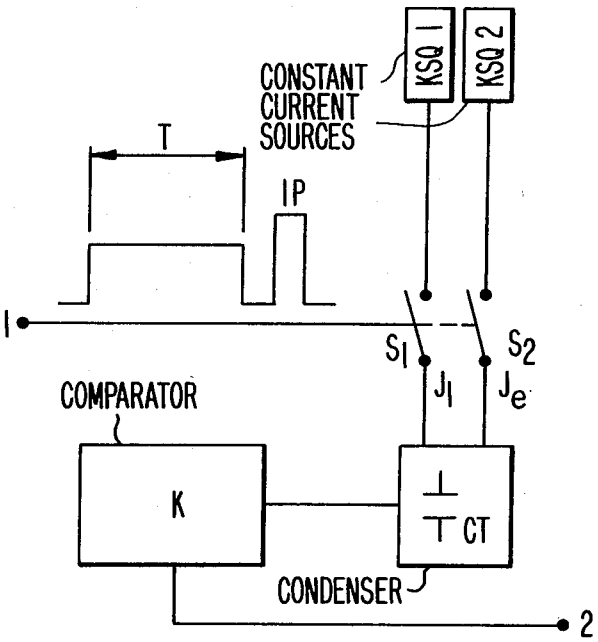

Instead of the shift register, a counter with decoder, a frequency submultiplier or the like can also be used. In FIG. 4 there is shown a delay time module from analogue switching technology. As a result of suitable signals—as for example described in connection with FIG. 2—the switch $S_1$ is closed in the programming phase for the time T. During this time, the time-base condenser CT is charged with the charging current $I_1$ from the constant current source KSQ1 from the initial voltage source $U_1$ to the end voltage $U_2$. The charging current $I_1$ behaves to the later flowing discharging current $I_e$ as $\Delta T$ behaves to T. After a time $t \geqq T$ the switch $S_2$ is closed, in accordance with a detonation signal from the detonating machine ZM which is the same for all detonators, and the time base condenser CT is charged with the discharge current $I_e$ by the constant current source KSQ2 acting as current sink. If the time base condenser CT has again reached the starting voltage $U_1$, a signal is generated by the connected comparator K through the output 2 to set off the signal at the detonation switch SZ and the detonation is triggered.

The setting of the time stage $m/n = I_1/I_e$ is determined by the ratio of the currents.

In FIG. 5 there is shown a further constructional example of a delay time module of analogue switching technology, in which the setting of the time stage m of the detonator takes place through the shift register SR corresponding to FIG. 3. As a result of suitable signals—as is described for example in connection with FIG. 3—the switch $S_1$ is closed for the time $\Delta T$ by means of the shift register SR. During this time, the constant current source KSQ supplies the constant current $I_1$ to the time base consenser CT which charges from the initial voltage $U_1$ to the end voltage $U_2$. After the time $\Delta T$ has passed, the switch $S_1$ is opened. The switch $S_2$ is then closed by means of a further detonation signal from the blasting detonating machine equal for all detonators, and the time base condenser CT is discharged through the KSQ now acting as current sink with the discharging current $I_e$ which is equal to the charging current $I_1$. Should the time base condenser reach the starting voltage $U_1$, then a signal to the detonation SZ is given out by comparator K through the output 2 and the detonation is triggered. The deviation of the delay time $\Delta T$ is, in this way, only dependent on the short term tolerances of the time base condenser CT, the constant current source KSQ and the comparator K.

In FIG. 6 there is shown a further possibility of time input according to the principle repeated in FIGS. 3 and 5. Here the frequency of the impulses given out by the blasting detonating machine ZM in the programming phase is no longer constant during the time T, but variable. That means that the chronological separation between the starting impulse 0 and the impulse 1 is other than that between the impulse 1 and the further impulse 2 etc.

Moreover, there is valid for the delay time of the m-th time step quite generally $$\Delta T_m = \sum_{1}^{m} \Delta t_i.$$

For example it can be provided in the concrete case that the impulse establishing the first time stage appears 10 ms after the starting impulse 0, that is $\Delta t_1 = 10$ ms. The second impulse may appear 30 ms later, therefore a total of 40 ms after the starting impulse, the third impulse for example 20 ms later, therefore 60 ms after the starting impulse, the fourth impulse for example 500 ms later, therefore 560 ms after the starting impulse, etc. A special $\Delta T_m$ is therefore provided by the blasting detonating machine ZM for each time stage m, whereby always $\Delta T_m > \Delta T_{m-1}$. This procedure offers the advantage that for each time stage m an arbitary delay time $\Delta T$ is adjusted by the blasting detonating machine and one can thus take into account still better the explosive technology requirements, optionally with a further reduced number of time stages. The initiation phase is also again triggered by the blasting detonating machine ZM by means of a further signal equal for all detonators, the detonation signal, which achieves the closing of the switch $S_2$ and the further discharge as described in FIGS. 3 or 5. It is determined differently when $S_1$ opens.

FIG. 7 shows a circuit arrangement with which not only can the delay time for release of the detonation switch SZ be set, but with it the setting of the delay time and the release is only carried out after an arming phase. The arrangement is connected through the connections 101 and 103 to the blasting detonating machine and receives from this firstly the arming signals and then the signals for setting of the delay and for release of the detonation. Furthermore, the current supply of the arrangement shown in the figure is obtained from these signals.

This takes place in the rectifier and processing unit 102 with which both connections 101 and 103 are connected and which rectifies the signals arriving there in order to permit a poling of the incoming lines and in particular also to be able to process signals which come together as bipolar exchange current impulses. The voltage obtained therefrom is supplied through the output 105 to a control switch 168 which charges condenser 172 with it and derives from this charge voltage a controlled operating voltage UB which represents the operating voltage of the electronic elements of the arrangement. Moreover the supply voltage of the condenser 172 is controlled in specific manner as is explained later. Furthermore the control switch 168 yields at the output P at the beginning of the first supplied signal an impulse which various elements of the illustrated arrangement reset to the starting setting as is explained likewise later.

The unit 102 further produces with each side or each front side of the exchange current impulses supplied through the connections 101 and 102 a short time signal to the line 109 as well as a time signal following thereon to the line 107 which is supplied through the switch 104 to the number rate input of a counter 106. The functions released thereby are explained with the aid of the time diagram in FIG. 8.

In FIG. 8 there is plotted in line a the exchange current signal arriving through connections 101 and 103. Firstly there is conveyed through connections 101 and 103 a somewhat longer signal whose time period must not be exactly defined but merely must suffice to charge up the condenser 172 to a predetermined minimum voltage. This charging potential of the condenser is shown in line d and it suffices for supplying the necessary operating potential for the electronic elements although not for detonating the detonating element ZE if the detonation switch SZ would be closed.

Next there appear a number of symmetrical impulses with respectively an impulse time ta. These are supplied through the initially closed switch 104 to the number rate input of the counter 106 and switches this again and indeed beginning from the zero setting, at which it was set by the already mentioned starting impulse P through the OR component 148, the line 149 and the input MR of the counter 106. As long as the counter 106 exists in the zero setting, a further counter 130 would likewise be kept in its zero setting through the input MR thereof.

As soon as the counter 106 leaves it zero setting, the counter 130 can again count the rate impulses which are supplied by the impulse generator IG through the AND component 118. Moreover the period length of these time impulses is essentially smaller than the impulse period ta of the exchange current impulse supplied thereto through the connections 101 and 103. The AND component 118 is opened by a corresponding release signal from the flip-flop 116 which would be set into this setting by the starting impulse P through the OR component 114. The counter 106 counts the further exchange current impulses which occur and correspondingly the counter 130 counts the time impulses of the impulse generator IG so that both counter settings in different measure, increase, as is made clear in lines b for the counter 106 and in line c of FIG. 8 for the counter 130. Moreover the counter settings for simplicity are shown increasing continuously in halves although it is in fact a question of a stepwise increase in the numerical setting.

As soon as the counter 106 has reached the setting NR, there is delivered through the line 117 a signal which is supplied to the AND components 122 and 142. The AND component 122 is opened through the conductor 165 which comes from the flip-flop 164 which would be set by the starting impulse P into the corresponding setting. Accordingly, there occurs the signal from the line 117 through the OR component 124 to the impulse former 126, which produces a short impulse which is supplied to the input CMP of the counter 130 and whose capacity inverts, that is changes around into an equally large negative numerical value. This is to be seen in FIG. 8 in line c.

The other input of the AND component 142 is stored by the output of a decoder 132 which is connected to the outputs 131 of the counter 130 and supplies a signal as long as the numerical setting lies below a defined value which here is denoted by ZEU. Moreover it is noted inter alia that there can be superimposed on the impulses produced by the blasting detonating machine spurious impulses which have been recorded in the counter 106 quicker than provided for, or, what is still more apparent, that, on employing of the explosive charge with the detonators, before the connection to the blasting detonating machine, spurious signals can be picked up which have set the arrangement into a setting which was not defined.

If therefore on reaching the numerical setting NR by means of the counter 106 the counter 130 has not yet reached the lower numerical setting ZEU, the AND component 142 yields at the output a signal which is supplied through the OR component 144 to the one input of an AND component 146 whose other input is connected with the line 165 so that the AND component 146 opens. Accordingly there is supplied to a corresponding input of the OR component 148 a signal which resets this to the zero value through the line 149 and the input MR of the counter 106 and prepares for the next arming process which is repeated at least once. Also the counter 130 is set in this way to zero.

If the counter 130, on reaching the setting NR has exceeded the counter setting ZEU by the counter 106, but in addition has also exceeded the setting ZEO, this is noted by a decoder 134 likewise connected at the output 131 of the counter 130, which then emits a starting signal which resets the AND component 146 or the counter 106 to the starting setting through the OR component 144. This resetting takes place usually independently on reaching the numerical setting ZEO through the counter 130, even if this takes place before achieving the numerical setting NR by means of the counter 106. In this way, it is for example noted that a few of the exchange current impulses produced by chance by the blasting detonating machine by bad contacts or short closures have erroneously arrived through the contacts 101 and 103.

On establishment of both numerical settings ZEU and ZEO, it is presupposed that the rate frequency of the impulse generator IG lies between predetermined limits, which is measured in the production of the arrangement before the incorporation of the detonator.

If the impulses from the blasting detonating machine up until the numerical setting NR of the counter 106 have not been correctly received, with this number also being established in the blasting detonating machine, there are then transferred from this impulses with doubled impulse period. During this time the counter 130 now counts in the forward direction again from the negative counting setting which as noted was produced by inversion. The measure of inverting has been chosen here for technical reasons, without which even the numerical direction of the counter 130 would have been able to be switched over.

As soon as the counter 106 has reached the counter setting NE, which is, on account of the doubling of the impulse period, equal to 1.5 times the counter setting NR, the counter 130 must have again reached the zero setting in the ideal case. Since the number rates of both counters 106 and 130 are however asynchronous with respect to one another and moreover small frequency variations occur, it is accepted that the arrangement has processed the impulses ordinarily produced by the blasting detonating machine if the counter 130, on reaching the numerical setting NE through the counter 106 reduces by no more than k settings from the zero setting, that is has reached either at least the counter setting -k or no higher than the counter setting k. This is checked in the decoder 140 which is likewise connected to the output 131 of the counter 130. In case, therefore, the decrease in the counter setting of the counter 130 from the zero setting is less than k settings, the decoder 140 produces at the output 141 a signal which, together with the signal at the line 121 yields with the counter setting NE of the counter 106 a signal at the output of the AND component 162 so that the flip-flop 164 is switched over and now a signal arrives at the line 167 instead of at the line 165. Furthermore the starting signal of the AND component 162 switches the flip-flop 154 through the OR component 152 and sets the counter 106 into the zero setting through the OR component 148 etc., whereby the counter 130 is also set into the zero setting as can be seen from FIG. 8. With the switching over of the flip-flop 164, the arming phase is ended since this flip-flop 164 is no longer reset and the programming phase can begin.

If however with the numerical setting NE of the counter 106 the lowering from the zero setting is greater than k settings, the decoder 140 produces at the output 143 a signal which produces with the signal at the line 121 and the signal at the line 165 of the flip-flop 164, which is not yet in the rest setting, a signal at the output of the AND component 166 which sets the counter 106 and accordingly also the counter 130 into the zero setting again through the OR component 148 and the line 159. In this way there is already the arrangement to receive a renewed sequence of arming impulses which is repeated by the blasting detonating machine basically at least once.

After the flip-flop 164 has been switched over, the condenser 172 is now charged to the maximum voltage through the signal at line 167 in the control circuit 168, which voltage, as is to be noted from line a of FIG. 8 is possible with the directly present signal from the blasting detonating machine. For this purpose a pause time tp is provided. After this pause time, there begins a new arming phase which again requires the time period te. At the switched over flip-flop 164, the counter 106 and also the counter 130 is now set anew into the zero setting in the described manner with each side of the exchange current impulse by means of the signal produced thus at the line 109 and the counter 106 is switched into the setting 1 at the line 107 by the impulse following independently thereon so that the counter 130 can count the rate signal of the impulse generator IG, for the flip-flop 116 is furthermore still in the setting in which it opens the AND component 118. This periodic reversal to the zero setting is represented in FIG. 8 in lines b and c.

At the end of the second arming phase te there occurs after the last side of the exchange current impulse a longer pause during which the counter 130 exceeds the setting ZPU which could not be achieved previously since the lengths of the impulses during the arming phases for this purpose were too short and both counters 106 and 130 were previously reset again to the zero setting. As soon as the setting ZPU is now reached, the decoder 138 which likewise is connected to the output 131 of the counter 130, produces an output signal and since the counter 106 is still in the setting 1, a signal is provided at the line 115 and similarly at the line 167 of flip-flop 164, so that the AND component 156 produces an output signal and resets the flip-flop 154 through the OR component 158 so that subsequently no resetting impulses for the counter 106 can be produced through the AND component 160. In this way the arming impulses are distinguished from the programming impulses for the setting of the delay time, which have a longer length, as is explained later.

Since however the pause after each arming phase is essentially longer than the longest programming impulse occurring, the counter 130 finally reaches the setting ZPO. On reaching this setting, the decoder 136 which is likewise connected to the output of counter 130 gives out an output signal and since the counter 106 is always still in the setting 1 and the line 115 conducts a signal, the AND component 150 and accordingly the OR component 152 produce an output signal which resets the counters 106 and 130 through the OR component 148 and the line 149 and again resets for its part flip-flop 154 so that then further resetting impulses to the zero setting of the counter 106 are again produced through the AND component 160, with, in described manner, the counter 130 likewise being set to zero. In this way, the pause in the exchange current signals received or more precisely the longer lasting maintenance of an approximately constant impulse potential is distinguished from the subsequent programming impulses. It may be indicated at this point that FIG. 8 is not true to scale.

With the first programming impulse with the length $\Delta t$, the counter 106 switches into the setting 1 and the counter 130 begins to count up from the zero setting. Since the minimal value of the impulse period $\Delta t$ of the programming impulses is so great that the counter 130 exceeds the setting ZPU, as long as the counter 106 is still in the setting 1, the flip-flop 154 is switched over so that the AND component 160 is again barred and then the following sides of the exchange current impulses received cannot produce any more resetting impulses for the counter 106. On the other hand the counter 130 with the following programming impulses only reaches the setting ZPO after the counter 106 has left the setting 1 so that the AND component 150 is only barred by the now erroneous signal in the line 115 and the flip-flop 154 is not switched over again.

In this way, the counter 130 counts the impulses of the impulse generator IG again, until the counter 106 has reached the setting Nk. This setting is provided through a multiple input 110 and is supplied to a decoder 108 which is connected in addition to the output 111 of the counter 106 and produces, on agreement of the signal combinations at the two multiple inputs an output signal and supplies it to the AND component 112 which is opened through the line 167 so that the flip-flop 116 changes over and the AND component 118 bars, as a result of which the counter 130 obtains no more rate impulses from the rate impulse generator IG. In this way, the setting reached by the counter 130 is retained at this moment, which setting in this way, as already described, represents a measure for the programmed delay time.

Independently of this however still further programming impulses arrive until finally the counter 106 is fully counted and an overflow signal is produced at the output 123. This overflow signal opens the switch 104 so that the counter 106 remains in this end setting and cannot turn back to its zero setting since otherwise the counter 130 would also set to zero, whereupon the adjusted delay time would also be lost.

Furthermore the overflow signal passes to the line 123 through the OR component 124 to the impulse former 126 which again releases a short impulse at the input CMP of the counter 130 and in this way inverts its counter setting, as already was described previously in the arming phase. In addition the flip-flop 116 is switched through the OR component 114 again so that the AND component 118 is released and the counter 130 again obtains impulses of the rate impulse generator IG and counts to zero from the negative setting produced by the inverting.

As soon as the counter 130 reaches the zero setting, the previously programmed delay time tv is cancelled after the last programming impulse counted by the counter 106 so that the detonation must be released. This happens in such a way that the counter 130 produces a signal, on achieving its zero setting from negative values, and supplies it to the AND component 170 which is released through the overflow signal to the line 123 so that the release signal of the AND component 170 can close the detonator switch SZ, with the charge stored in the condenser 172 discharging itself through the detonation element ZE and bringing this to detonation.

With the last programming impulse with which the counter 106 reaches its end setting, should the supply of signals through the lines 101 and 103 be interrupted, it may be that the blasting detonating machine switches off the energy supply, it may be that the detonators with the shortest delay time discontinues through releasing the connection with the blasting detonating machine. The condenser 172 therefore contains no more energy for the length of the delay time and the voltage present therein drops slowly through use of energy by the illustrated arrangement. Since for the detonation of the detonation element ZE, a minimum voltage is necessary at the condenser 172, the unit 168 monitors this voltage and if this falls below a predetermined limit, at which the safe release of the detonation element is no longer guaranteed, the detonation switch SZ is likewise put into operation and the detonation initiated, although the predetermined delay time has possibly not elapsed. If this would not be provided for it could happen that the operational voltage UB for the operation of the electronic arrangement does not suffice and the AND component 170 finally switches the detonation switch SZ through its output signal, that however at this moment the energy stored in the condenser 172 no longer suffices to initiate the detonation element so that after blasting a still not detonated charge would remain in the debris, which must be avoided under all circumstances. This last set out case can however only be encountered with an error, particularly with a too small capacity of the condenser 172 as a consequence of unduly great tolerances.

Because of the described arrangement with the arming phase connected in series to programming of the delay time, what is achieved is that the adjustment of the delay time and initiation of detonation only takes place by means of the impulses provided therefor by the blasting detonating machine so that a safety which is as great as possible is guaranteed.

The circuit arrangement described in FIG. 7 may also be used generally as appropriate if accordingly an arrangement in a receiver is to be activated for example as a result of signals which are transmitted by a sender to a receiver, through a possibly disturbed stretch when in no case is the receiver to be activated by stray signals. In this way, the activation signal is then transmitted independently after the or the last arming phase and is only utilised on switching over of flip-flop 164.

We claim:

1. A process for the chronologically staggered initiation of electronic delay detonators with individual delay times with respect to a command signal from a blasting detonating machine, which is connected with at least one of the explosive delay detonators and a parallel circuit to at least one detonation circuit, in which in a charging phase determined by time signals from the blasting detonating machine, for the adjustment of the individual delay time, in each of these detonators a first signal current from a source is supplied to an integrator and in a subsequent delay phase, beginning in all detonators simultaneously with the command signal, a second signal current having a predetermined ratio relationship to the first signal current is supplied to the integrator sufficiently long until the integral of the first signal current stored in the integrator is one of reached and decreased to zero, whereupon the detonation is initiated characterized in that the supply of the first signal currents to the integrators of all detonators begins simultaneously and for each detonator the individaul delay time is only determined through the end of the supply of the first signal current in dependence on the time signals and by the ratio of the two signal currents to one another.

2. Process according to claim 1, characterized in that the blasting detonating machine produces a sequence of n impulses and in each detonator the individaul delay time is formed by counting off of a corresponding number m of these impulses.

3. Process according to claim 2, characterized in that the blasting detonating machine produces an adjustable irregular sequence of impulses.

4. Process according to claim 2, characterized in that the blasting detonating machine produces a regular sequence of impulses.

5. Process according to claim 1, characterized in that the signal currents are impulse frequencies and the impulse frequency of the first signal current and of the second signal current have a fixed ratio which is less than one and determines the individual delay time.

6. Process according to claim 1, characterized in that constant currents are used as signal, currents.

7. Process according to claim 1, characterized in that the first signal current is equal to the second signal current and that the supply of the first signal current to the integrators of all detonators is maintained over a time determined by the time signals of the blasting detonating machine each according to its detonator.

8. Process according to claim 1, characterized in that, before the time signal from the blasting detonating machine a first predetermined number of release impulses is transmitted in a first time sequence and during its length one of the signal currents is integrated and then a second predetermined number of starting impulses different from the first number is transmitted in a time sequence differing from the first time sequence although having the same length and during this period this signal current is likewise integrated, and that then the detonation is only initiated if the difference between the integral formed during the first time period and the integral formed during the second time period lies below a predetermined limit after the receipt of a predetermined total number of impulses.

9. Process according to claim 8, characterized in that the first time sequence is a predetermined first constant frequency and the second time sequence a predetermined second constant frequency.

10. Process according to claim 8, characterized in that the sequence one after the other of the first and second time sequences is repeated at least once and the release of the starting impulse only then takes place if at the end of at least a second time sequence the difference of the two integrals lies below the predetermined limit, and that with a greater difference the integrals are reset to a starting value.

11. Process according to claim 8, characterized in that a shortest length of time of at least the first of the time signals supplied by the blasting detonating machine is approximately a predetermined factor greater than a longest length of time of the release impulse and that by the first impulse which is received one of after the end of the second time sequence and the predetermined number of second time sequences, and at which end the integral of the signal current has exceeded a predetermined second limit, the signals received from the blasting detonating machine are evaluated as time signals.

12. Process according to claim 10, characterized in that the integral obtained at the end of the first time sequence is compared with a predetermined limiting value and on exceeding this limiting value the integral is set back to the starting value.

13. Process according to claim 1, characterized in that the value of the integral obtained at one of the end of the charging phase and at the end of each first time period is set to the opposite value and then is integrated in the same direction as previously.

14. Process according to claim 8, in which the explosive delay detonator includes an energy storer to which external energy is supplied and which energizes the elements of the electronic explosive charge detonator and supplies the energy to the detonators of the detonating element, characterized in that the energy supply to the energy storer is limited to a value between that for storage energizing of the electronic elements and that for detonation of the detonating element, until one of at the end of the second time sequence and of a predetermined number of second time sequences, the difference of the two integrals lies below the predetermined limit and the maximum energy is supplied to the energy storer.

15. Electronic explosive delay detonator for connection to a blasting detonating machine supplying at least one time signal, with a signal source, which supplies, in a charging phase determined by the time signal, a first signal current for the charging of an integrator, and with a control arrangement, which, after elapse of the charging phase, enters a delay phase in which the signal source supplies a second signal current one of for discharging and for renewed charging of the integrator, with a detonation signal being produced if one of the contents of the integrator has decreased to a predetermined value and on renewed charging of the integrator, the stored integration value of the charging phase is reached, characterized in that the signal source is changeable so that it produces the two signal currents with different values corresponding to a predetermined ratio to one another.

16. Electronic explosive delay detonator according to claim 15, characterized in that the signal source contains an impulse generator to which a frequency, divider is connected and that the first signal current runs through the frequency divider and the second signal current runs directly from the impulse generator to the integrator formed as a counter.

17. Electronic explosive delay detonator according to claim 15, characterized in that the signal source contains two constant current sources with different current values and that the integrator contains a charge condenser.

18. Electronic explosive delay detonator for connection to at least one time signal supplying blasting detonating machine, with a signal source, which, in a charging phase determined by the time signal, supplies a first signal current for charging of an integrator, and with a control arrangement which after elapse of the charging phase, enters a delay phase in which the signal sources supply a second signal current for one of discharging and for new charging of the integrator, with a detonation signal being produced if one of the contents of the integrator are decreased to a predetermined value and with renewed charging of the integrator, the stored integration value of the charging phase is reached, characterized in that the control arrangement of each detonator introduces the first signal current beginning with the first impulse of the time signal supplied as an impulse sequence and maintains it up to an m-th impulse set specifically according to the detonator and begins the second signal current at the n-th impulse of the time signal, with m being $\leqq$ to n.

19. Electronic explosive delay detonator according to claim 18, characterized in that the first and the second signal currents are the same.

20. Electronic explosive delay detonator according to claim 15 in which the control arrangement contains a counter characterized in that a storage element is provided and that a predetermined numerical setting of the counter corresponding to the sum of the numbers of the impulses transmitted from the blasting detonating machine in a first and a second time sequence following thereon switches over the first storage element if an integral formed during the first time sequence in the integrator differs from an integral formed during the second time sequence to approximately less than a predetermined value, and that the storage element only enables the initiation of the detonation in the switched over setting.

21. Electronic explosive delay detonator according to claim 20, characterized in that a monitoring circuit is provided which resets the integrator and the counter to its starting setting if the integral at the end of the first time sequence lies outside predetermined first limits.

22. Electronic explosive delay detonator according to claim 21, characterized in that the monitoring circuit resets the integrator and the counter, in addition, to the starting setting if, after the switching over of the storage element the integral at the end of an impulse from the blasting detonation machine lies outside predetermined second limits.

23. Electronic explosive delay detonator according to claim 20, in which an energy storer for the operation of the electronic elements and the detonating element, supplied from externally, is provided, characterized in that only the switched over storage element releases the charging of the energy storer at a value sufficing for the detonation of the detonation element.

24. A process for the chronologically staggered initiation of a plurality of electronic explosive delay detonators having individual delay times with respect to a command signal from a blasting detonation apparatus coupled with the explosive delay detonators, comprising the steps of:

supplying a timing signal from the blasting detonation apparatus to the explosive delay detonators;

simultaneously initiating a charging phase in each of the explosive delay detonators in response to the timing signal by supplying a first signal to an integrating means having an initial value for a period related to the individual delay time of the respective explosive delay detonator and for storing the integrated value of the first signal;

supplying the command signal from the blasting detonation apparatus to the explosive delay detonators;

simultaneously initiating a delay phase in each of the explosive delay detonators in response to the command signal by supplying a second signal to the integrating means for a period sufficient to enable the integrating means to obtain one of a value equal to the stored integral value of the first signal and a value representing a decrease of the stored integral value of the first signal to the initial value of the integrating means, the second signal having a predetermined relation to the first signal; and initiating detonation of a respective delay detonator when the integrating means obtains one of the values in the delay phase.

25. A process according to claim 24, wherein the step of supplying a timing signal from the blasting detonation apparatus includes supplying a sequence of n pulses, the charging phase being carried out by supplying the first sighal to the integrating means for a period related to the individual delay time corresponding to a predetermined number m of the n pulses,where $m \leqq n$.

26. An apparatus for the chronologically staggered initiation of a plurality of electronic explosrve delay detonator means having individual delay times comprising blasting detonation means coupled with a plurality of electronic explosive delay detonator means, the blasting detonation means generating at least a timing signal and a command signal, each of the electronic explosive delay detonator means including signal generating means for supplying first and second signals having a predetermined relation to one another, integrating means having an initial value, control means responsive to the timing signal for simultaneously initiating a charging phase in each of the explosive delay detonator means by enabling the supply of the first signal to the integrating means for a period related to the individual delay time of a respective explosive delay detonator means, the integrating means storing the integrated value of the first signal, the control means being responsive to the command signal for simultaneously initiating a delay phase in each of the explosive delay detonator means by enabling the supply of the second signal to the integrating means for a period sufficient for the integrating means to obtain one of a value equal to the stored integral value of the first signal and a value representing a decrease of the stored integral value of the first signal to the initial value of the integrating means, and detonation initiation means for initiating detonation of a respective delay detonator means in response to the integrating means obtaining one of the values in the delay phase.

27. An apparatus according to claim 26, wherein the blasting detonation means generates the timing signal as a sequence of n pulses, the control means being responsive to a predetermined number m of the n pulses for enabling the supply of the first signal to the integrating means, where $m \leqq n$.

28. An electronic explosive delay detonator arranged for connection with a blasting detonation means supplying at a plurality of timing signals, the electronic explosive delay detonator comprising signal generating means for supplying a first signal and a second signal, the first signal having a predetermined relation to the second signal, integrating means having an initial value for integrating a signal supplied thereto, control means responsive to one of the time signals for initiating a charging phase in the explosive delay detonator by enabling the supply of the first signal from the signal generating means to the integrating means for a period related to the delay time of the explosive delay detonator, the integrating means storing the integrated value of the first signal, the control means being responsive to another timing signal for initiating a delay phase in the explosive delay detonator by enabling the supply of the second signal from the signal generating means to the integrating means for a period sufficient or the integrating means to obtain one of a value equal to the stored integral value of the first signal and a value representing the decrease of the stored integral value of the first signal to the initial value of the integrating means, and detonation initiation mean for initiation detonation of the explosive delay detonator in response to the integrating means obtaining one of the values in the delay phase.

29. An electronic explosive delay detonator according to claim 28, wherein the plurality of timing signals supplied by the blasting detonation means is in the form of a sequence of n pulses, the control means being responsive to the first pulse of the pulse sequence for enabling the supply of the first signal to the integrating means for a period related to the individual delay time of the electronic explosive detonator corresponding to a predetermined number m of the n pulses where $m \leqq n$.

30. An electronic explosive delay detonator according to claim 29, wherein the control means is responsive to the n-th pulse of the n pulses for enabling the supply of the second signal to the integrating means.

* * * * *